US007755572B2

(12) United States Patent
Moon

(10) Patent No.: US 7,755,572 B2
(45) Date of Patent: Jul. 13, 2010

(54) PLASMA DISPLAY APPARATUS AND DRIVING METHOD THEREOF

(75) Inventor: Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 812 days.

(21) Appl. No.: 11/478,136

(22) Filed: Jun. 30, 2006

(65) Prior Publication Data

US 2007/0001935 A1 Jan. 4, 2007

(30) Foreign Application Priority Data

Jul. 1, 2005 (KR) ..... 10-2005-0059435

(51) Int. Cl.
*G09G 3/28* (2006.01)

(52) U.S. Cl. ..... 345/60; 345/63

(58) Field of Classification Search ..... 345/60–72; 315/169.4

See application file for complete search history.

(56) References Cited

U.S. PATENT DOCUMENTS

| | | | | |
|---|---|---|---|---|
| 5,877,734 | A * | 3/1999 | Amemiya | 345/60 |
| 2002/0067136 | A1 | 6/2002 | Okamura et al. | 315/169.3 |
| 2002/0109650 | A1 * | 8/2002 | Kougami et al. | 345/60 |
| 2004/0085262 | A1 * | 5/2004 | Lee | 345/41 |
| 2004/0090395 | A1 * | 5/2004 | Park | 345/41 |
| 2004/0150354 | A1 * | 8/2004 | Setoguchi et al. | 315/169.4 |
| 2005/0099365 | A1 * | 5/2005 | Lee | 345/63 |

FOREIGN PATENT DOCUMENTS

| | | | |
|---|---|---|---|
| EP | 1 336 950 | A2 | 8/2003 |
| EP | 1 585 096 | A2 | 10/2005 |
| JP | 2001-013910 | | 1/2001 |
| KR | 10-2003-0069024 | A | 8/2003 |

OTHER PUBLICATIONS

European Search Report dated Nov. 6, 2006.

* cited by examiner

*Primary Examiner*—Amr Awad
*Assistant Examiner*—Aaron Midkiff
(74) *Attorney, Agent, or Firm*—KED & Associates, LLP

(57) ABSTRACT

A plasma display apparatus and driving method thereof are disclosed. The plasma display apparatus comprises: a plasma display panel comprising scan electrodes and sustain electrodes, a scan driver for supplying a first pulse to the scan electrodes before a reset period of a first subfield, a first reset pulse gradually falling after maintaining a constant voltage to the scan electrodes during the reset period, and a second reset pulse having a voltage higher than the constant voltage of the first reset pulse to the scan electrodes during a reset period of a second subfield and a sustain driver for supplying a second pulse with a polarity opposite a polarity of the first pulse to the sustain electrodes corresponding to the first pulse before the reset period.

18 Claims, 6 Drawing Sheets

PLASMA DISPLAY APPARATUS AND DRIVING METHOD THEREOF

CROSS-REFERENCE TO RELATED APPLICATION

This non-provisional application claims priority under 35 U.S.C §119(a) on patent application Ser. No. 10-2005-0059435 filed in Korea on Jul. 1, 2005, the entire contents of which are hereby incorporated by reference.

BACKGROUND OF THE INVENTION

1. Field of the Invention

This document relates to a plasma display apparatus, and more particularly to a plasma display apparatus and a driving method thereof.

2. Description of the Background Art

Usually, a plasma display apparatus comprises a plasma display panel and a driver for driving the plasma display panel.

In the plasma display panel, one discharge cell is formed by a barrier rib between a front panel and a rear panel. A main discharge gas such as Ne, He and mixture (Ne+He) thereof, and an inactive gas containing a small amount of xenon are filled in each discharge cell. These discharge cells collectively form one pixel. For example, a red (R) discharge cell, a green (R) discharge cell, and a blue (B) discharge cell collectively form one pixel.

Furthermore, when the plasma display panel is discharged by a high frequency voltage, the inactive gas generates vacuum ultraviolet (UV) rays and emits light from a phosphor formed between the barrier ribs to realize an image. Since the plasma display panel can be made thin and lightweight, it has been spotlighted as the next-generation display.

The plasma display panel comprises a plurality of electrodes, for example, scan electrodes Y, sustain electrodes Z, and address electrodes X. A discharge is caused by applying a predetermined driving voltage to the plurality of electrodes, so that the image is realized.

As such, in order to realize the image, a driver for applying the predetermined driving voltage is connected to the electrodes of the plasma display panel. For example, in the electrodes of the plasma display panel, an address driver is connected to the address electrodes X, and a scan driver is connected to the scan electrodes Y.

A plasma display apparatus comprises the plasma display panel having the plurality of electrodes, and a plurality of drivers for applying the predetermined driving voltage to the plurality of electrodes of the plasma display panel.

In a plasma display panel of a conventional plasma display apparatus, when a reset pulse is supplied to the scan electrodes (Y), a positive high-voltage (i.e., setup voltage) is applied by a gradually increasing waveform, and a negative scan voltage is applied by a ramp-down waveform. As a result thereof, a voltage difference is caused between the positive high-voltage and the negative scan voltage. In order to control or insulate the voltage difference, a switching device having high internal voltage or a separate switching device has been used.

According to the conventional plasma display apparatus, by using the high-voltage switching device, manufacturing cost of the plasma display apparatus is increased, and a resistance value is increased, thereby resulting in production of heat or voltage decrease due to a driving resistance.

Further, due to the high voltage, a connection part between adjacent devices needs to be insulated, thereby causing a breakdown or an error operation of the device.

SUMMARY OF THE INVENTION

Accordingly, an object of the present invention is to solve at least the problems and disadvantages of the background art.

An object of the present invention is to provide a plasma display apparatus and driving method thereof that can simplify the constitution and lower manufacturing cost by unusing a high-voltage switching device, and be driven by a low voltage by decreasing a peak voltage of a reset pulse.

Additional advantages, objects and features of the invention will be set forth in part in the description which follows and in part will become apparent to those having ordinary skill in the art upon examination of the following or may be learned from practice of the invention.

According to an aspect of the present invention, there is provided a plasma display apparatus, which comprises a plasma display panel comprising scan electrodes and sustain electrodes, a scan driver for supplying a first pulse to the scan electrodes before a reset period of a first subfield, a first reset pulse gradually falling after maintaining a constant voltage to the scan electrodes during the reset period, and a second reset pulse having a voltage higher than the constant voltage of the first reset pulse to the scan electrodes during a reset period of a second subfield and a sustain driver for supplying a second pulse with a polarity opposite a polarity of the first pulse to the sustain electrodes corresponding to the first pulse before the reset period.

According to another aspect of the present invention, there is provided a plasma display apparatus, which comprises a plasma display panel comprising scan electrodes and sustain electrodes, a scan driver for supplying a first pulse to the scan electrodes before a reset period, a reset pulse gradually falling after maintaining a constant voltage to the scan electrodes during the reset period, a scan pulse to the scan electrodes in an address period, and a sustain pulse to the scan electrodes in a sustain period and a sustain driver for supplying a second pulse with a polarity opposite a polarity of the first pulse to the sustain electrodes corresponding to the first pulse before the reset period, wherein a first pulse, the falling reset pulse and the scan pulse are generated from the same voltage source.

According to still another aspect of the present invention, there is provided a method of driving a plasma display apparatus, which comprises supplying a first pulse to scan electrodes before a reset period, supplying a second pulse with a polarity opposite a polarity of the first pulse to the sustain electrodes corresponding to the first pulse before the reset period, supplying a reset pulse gradually falling after maintaining a constant voltage to the scan electrodes during the reset period and supplying alternately a sustain pulse to the scan electrodes and sustain electrodes in a sustain period.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
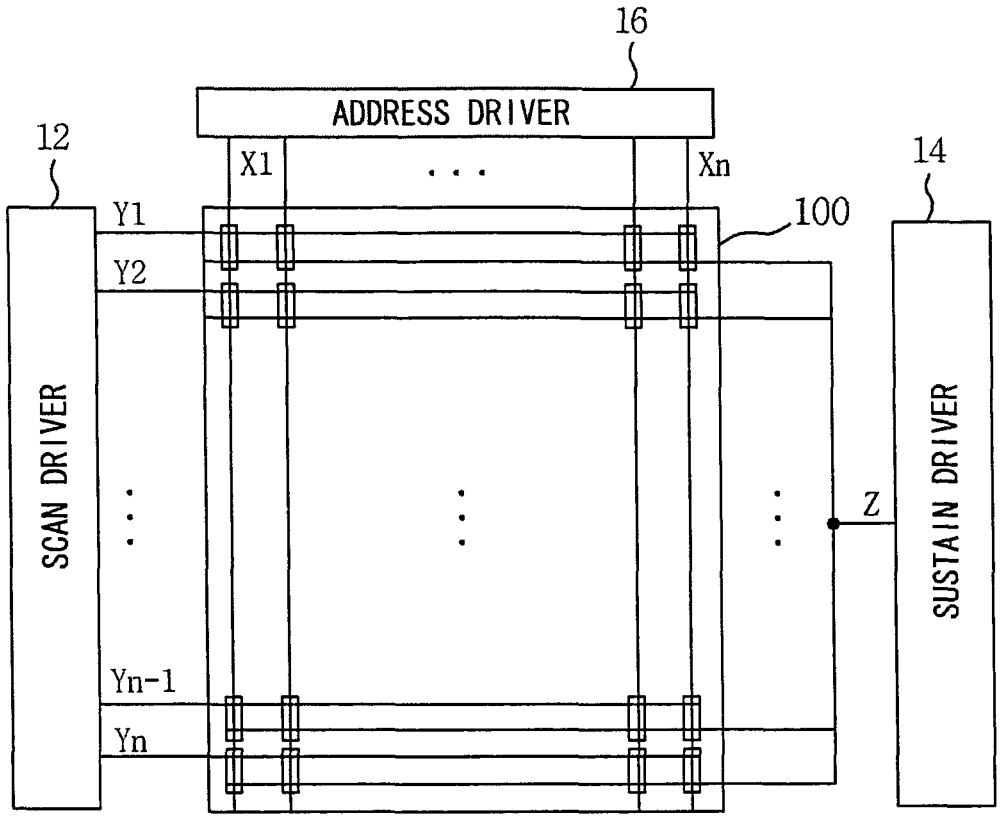
FIG. 1 is a diagram illustrating the structure of a plasma display apparatus according to an embodiment of the present invention.

Embodiments of the present invention will be described in a more detailed manner with reference to the drawings.

According to an aspect of the present invention, there is provided a plasma display apparatus, which comprises a plasma display panel comprising scan electrodes and sustain electrodes, a scan driver for supplying a first pulse to the scan electrodes before a reset period of a first subfield, a first reset pulse gradually falling after maintaining a constant voltage to the scan electrodes during the reset period, and a second reset pulse having a voltage higher than the constant voltage of the first reset pulse to the scan electrodes during a reset period of a second subfield and a sustain driver for supplying a second pulse with a polarity opposite a polarity of the first pulse to the sustain electrodes corresponding to the first pulse before the reset period.

The first pulse is a negative pulse and the second pulse is a positive pulse.

The first pulse falls with a predetermined slope from a ground voltage to a first voltage.

The first voltage is substantially equal to a negative scan voltage that is applied to the scan electrodes in an address period.

The voltage of the second pulse is substantially equal to a sustain voltage that is applied to the sustain electrodes in a sustain period.

The constant voltage of the first reset pulse is substantially equal to the sustain voltage that is applied to the scan electrodes in the sustain period.

The second reset pulse comprises a gradually increasing pulse.

A time for maintaining a peak voltage of the second reset pulse is shorter than a time for maintaining the constant voltage of the first reset pulse.

According to another aspect of the present invention, there is provided a plasma display apparatus, which comprises a plasma display panel comprising scan electrodes and sustain electrodes, a scan driver for supplying a first pulse to the scan electrodes before a reset period, a reset pulse gradually falling after maintaining a constant voltage to the scan electrodes during the reset period, a scan pulse to the scan electrodes in an address period, and a sustain pulse to the scan electrodes in a sustain period and a sustain driver for supplying a second pulse with a polarity opposite a polarity of the first pulse to the sustain electrodes corresponding to the first pulse before the reset period, wherein a first pulse, the falling reset pulse and the scan pulse are generated from the same voltage source.

The same voltage source is a negative scan voltage source.

The constant voltage of the reset pulse and a sustain voltage of the sustain pulse are generated from the same voltage source.

The same voltage source is a sustain voltage source.

The scan driver comprises a sustain supply controller for supplying the constant voltage of the reset pulse and the sustain pulse to the scan electrodes, and a negative scan voltage supply controller for supplying the first pulse and the falling reset pulse to the scan electrodes.

The first pulse is a negative pulse and the second pulse is a positive pulse.

According to still another aspect of the present invention, there is provided a method of driving a plasma display apparatus, which comprises supplying a first pulse to scan electrodes before a reset period, supplying a second pulse with a polarity opposite a polarity of the first pulse to the sustain electrodes corresponding to the first pulse before the reset period, supplying a reset pulse gradually falling after maintaining a constant voltage to the scan electrodes during the reset period and supplying alternately a sustain pulse to the scan electrodes and sustain electrodes in a sustain period.

The first pulse is a negative pulse, and the second pulse is a positive pulse.

The constant voltage of the reset pulse is substantially equal to a voltage of the sustain pulse.

A voltage of the second pulse is substantially equal to a voltage of the sustain pulse.

A bias voltage is applied to the sustain electrodes during the falling reset pulse period.

The bias voltage applied to the sustain electrodes is a positive voltage.

Hereinafter, various exemplary embodiments on a plasma display apparatus and a driving method thereof will be described in detail with reference to the accompanying drawings.

FIG. 1 is a diagram illustrating the structure of a plasma display apparatus according to an embodiment of the present invention.

Referring to FIG. 1, the plasma display apparatus comprises a plasma display panel 100, and a plurality of drivers for supplying a predetermined driving voltage to a plurality of electrodes of the plasma display panel 100. Preferably, the drivers comprise, for example, an address driver 16, a scan driver 12, and a sustain driver 14.

Preferably, the plasma display panel 100 comprises a front panel (not shown) and a rear panel (not shown) that are spaced by a constant distance and combined to each other, and a plurality of scan electrodes (Y) and a plurality of sustain electrodes (Z).

The structure of the plasma display panel 100 will be explained in detail with reference to FIG. 2.

Figure 2:
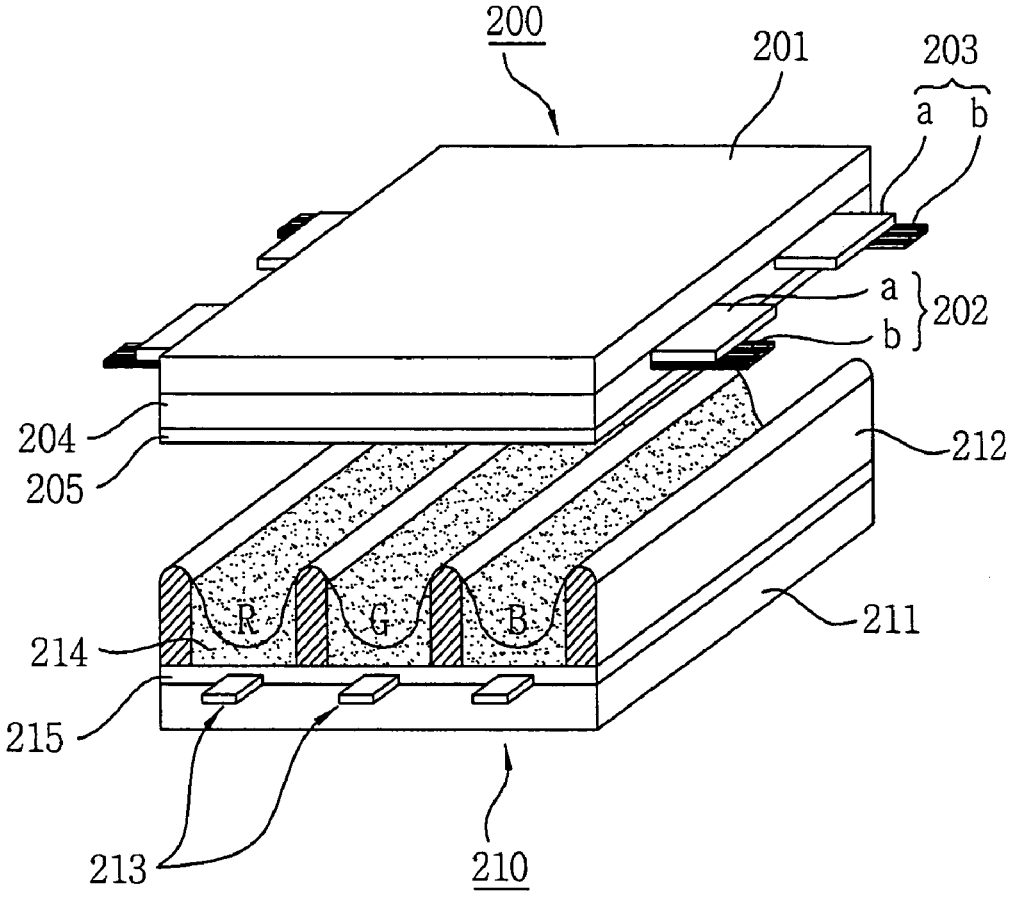
FIG. 2 is a diagram illustrating the structure of a plasma display panel in the plasma display apparatus according to an embodiment of the present invention.

FIG. 2 is a diagram illustrating the structure of a plasma display panel in the plasma display apparatus according to an embodiment of the present invention;

Referring to FIG. 2, the plasma display panel 100 in the plasma display apparatus comprises a front panel 200 and a rear panel 210, in which they are spaced by a constant distance and combined in parallel to each other. The front panel 200 is configured by forming a plurality of scan electrodes (Y) 202 and a plurality of sustain electrodes (Z) 203 on a front substrate 201, i.e., a display surface on which an image is displayed. The rear panel 210 is configured by forming a plurality of address electrodes (X) 213 on a rear substrate 211 that forms a back surface, so that the address electrodes (X) 213 intersects with the scan electrodes 202 and sustain electrodes 203.

In the front panel 200, the respective scan electrodes 202 are paired with the respective sustain electrodes 203, so that the electrodes 202 and 203 discharge each other in one discharge cell and sustain electroluminescence of the discharge cell. The respective scan electrodes 202 and sustain electrodes 203 include a transparent electrode (a) formed of transparent indium tin oxide (ITO) and an electrode bus (b) formed of metal materials. Additionally, the scan electrodes 202 and sustain electrodes 203 are covered with one or more top dielectric layers for restricting a discharge current and insulating the paired electrodes from each other. A protective layer 205, on which MgO is deposited, is formed on an upper surface in order to facilitate a discharge condition.

In the rear panel 210, one or more stripe type (or well type) barrier ribs 212 form a plurality of discharge spaces (i.e., discharge cells) and are arranged in parallel with each other. The plurality of address electrodes 213 perform the address discharge to generate vacuum ultraviolet (UV) rays, and are arranged in parallel with the barrier ribs 212.

An upper surface of the rear panel 210 is coated with R, G, and B phosphors 214 that emit visible rays to display the image during sustain discharge. A lower dielectric layer 215 is formed between the address electrodes 213 and the phosphors 214 to protect the address electrodes 213.

Only one example of the plasma display panel applicable to the present invention is shown and explained in FIG. 2, but is not limited thereto.

Although in FIG. 2 is shown that the respective scan electrodes 202 and sustain electrodes 203 are configured of the transparent electrode (a) and the bus electrode (b), at least one or more of the scan and sustain electrodes 202 and 203 may be configured only of the transparent electrode (a) or the bus electrode (b).

In addition, although in FIG. 2 is shown that the scan electrodes 202 and sustain electrodes 203 are included in the front panel 200, and the address electrodes 213 are included in the rear panel 210, all the electrodes 202, 203 and 213 may be form in the front panel, or at least any one of the electrodes 202, 203 and 213 may be formed on the barrier rib 212.

According to an embodiment of the present invention, the scan electrodes 202 for supplying a driving voltage, the sustain electrodes 203 and the address electrodes 213 are formed in the plasma display panel, considering only conditions explained in FIG. 2 irrespective of the other conditions.

Referring again to FIG. 1, the scan driver 12 drives the scan electrodes X by applying a voltage of a ramp-down pulse, i.e., a set-down voltage, to the scan electrodes Y of the plasma display panel 100 in the reset period, applying the negative scan voltage of the scan pulse, and applying a voltage Vs of the sustain pulse in the sustain period.

Further, a first pulse having a negative polarity is applied before the reset period. The explanation will be described in detail below.

The sustain driver 14 drives the sustain electrodes Z by applying a voltage Vs of the sustain pulse to the sustain electrodes Z in the sustain period that displays the image, and applying a sustain bias voltage in an address period.

Further, a second pulse having a positive polarity is applied before the reset period. The explanation will also be described in detail below.

The address driver 16 drives the address electrodes X by applying a voltage Va of a data pulse to the address electrodes X of the PLASMA DISPLAY PANEL 100 in an address period.

Figure 3:
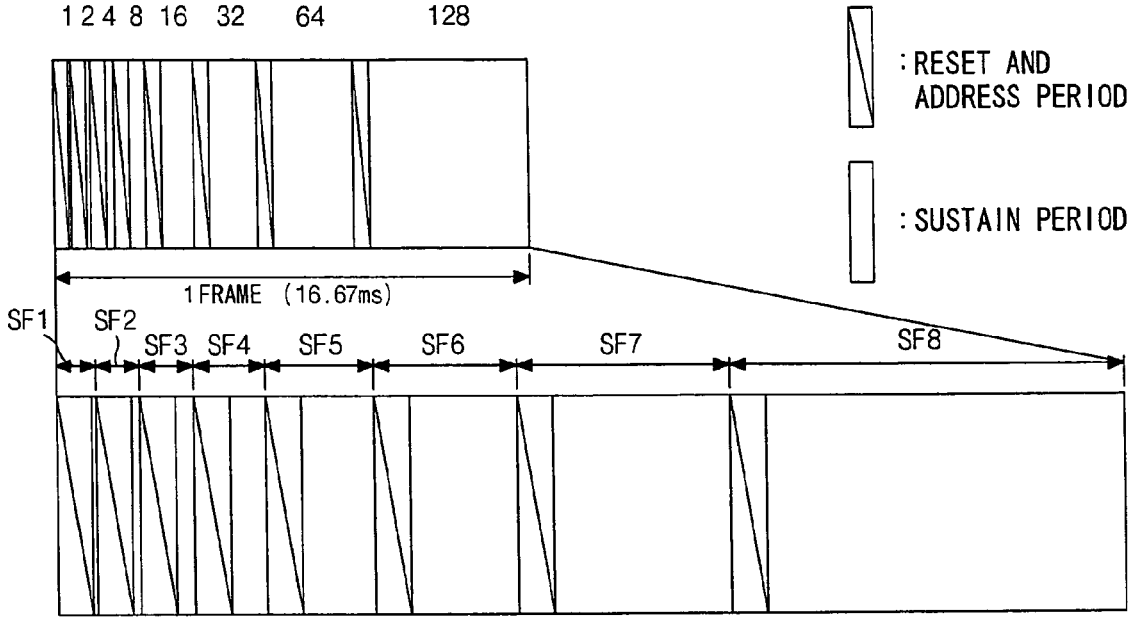
FIG. 3 is a diagram illustrating a subfield pattern of a 8-bit default code for realizing 256 gray scales in the plasma display apparatus according to an embodiment of the present invention.

FIG. 3 is a diagram illustrating a subfield pattern of a 8-bit default code for realizing 256 gray scales in the plasma display apparatus according to an exemplary embodiment of the present invention.

Referring to FIG. 3, the plasma display panel is time-divisional driven by dividing one frame period into a plurality of subfields to realize gray scale image, the subfields having the different number of emissions.

Each sub-field is divided into a reset period for initializing a screen, an address period for selecting the scan lines and discharge cells in the selected scan lines, and a sustain period for realizing gray scale display in accordance with the number of discharges. For example, when 216 gray scale image is displayed, a frame period (16.67 ms) corresponding to 1/20 second is divided into eight subfields SF1~SF8.

The eight subfields SF1~SF8 are respectively divided into the reset period RP, the address period AP, and the sustain period SP.

At this time, the reset period RP and address period AP of each sub-field are the same, while the sustain period SP of each sub-field and the number of sustain pulses allocated in the sustain period SP are increased in a ratio of 2n (n=0, 1, 2, 3, 4, 5, 6, and 7)

Only one example of the sub-field pattern applicable to the present invention is shown and explained in FIG. 3, but is not limited thereto.

Figure 4:
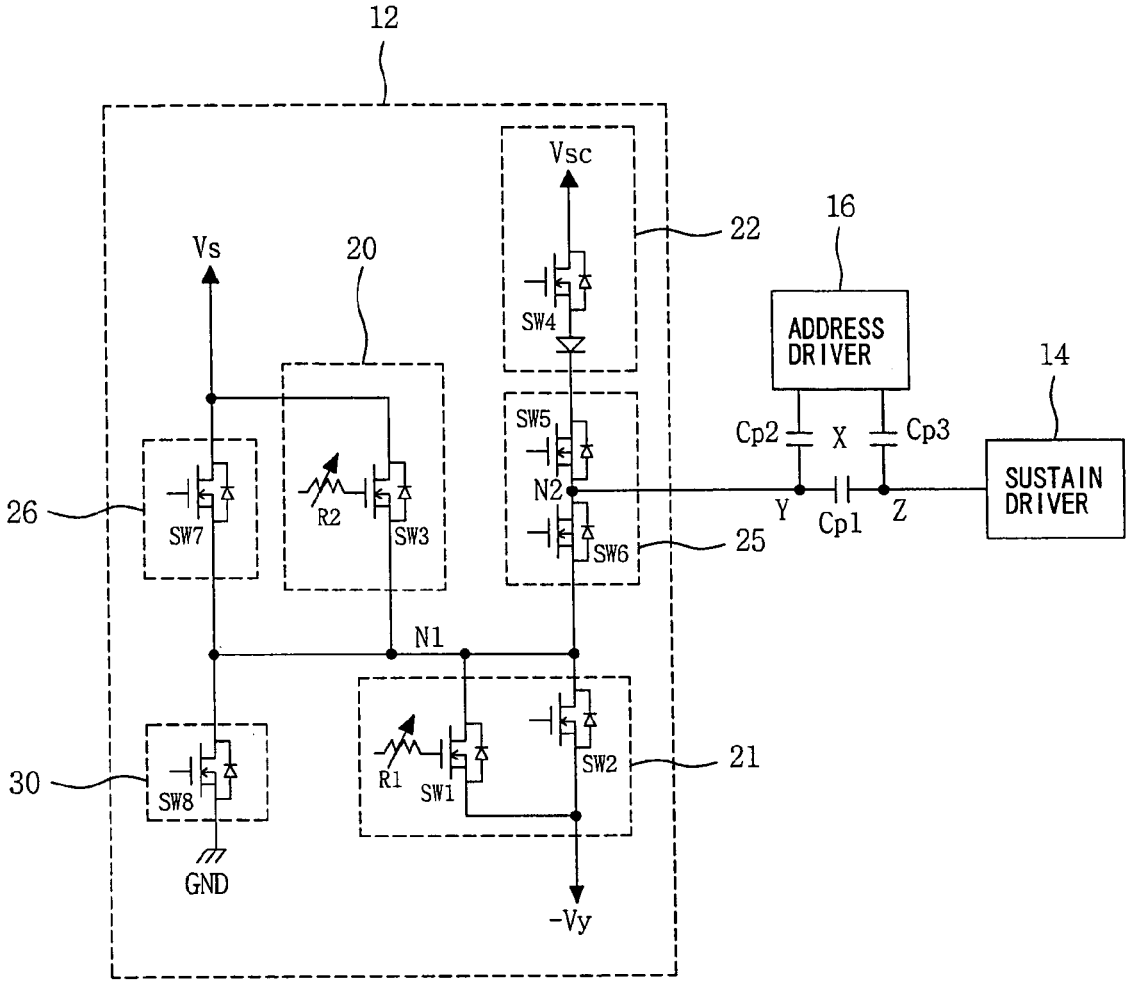
FIG. 4 is a block diagram illustrating the constitution of a scan driver in the plasma display apparatus according to an embodiment of the present invention.
Figure 5A:
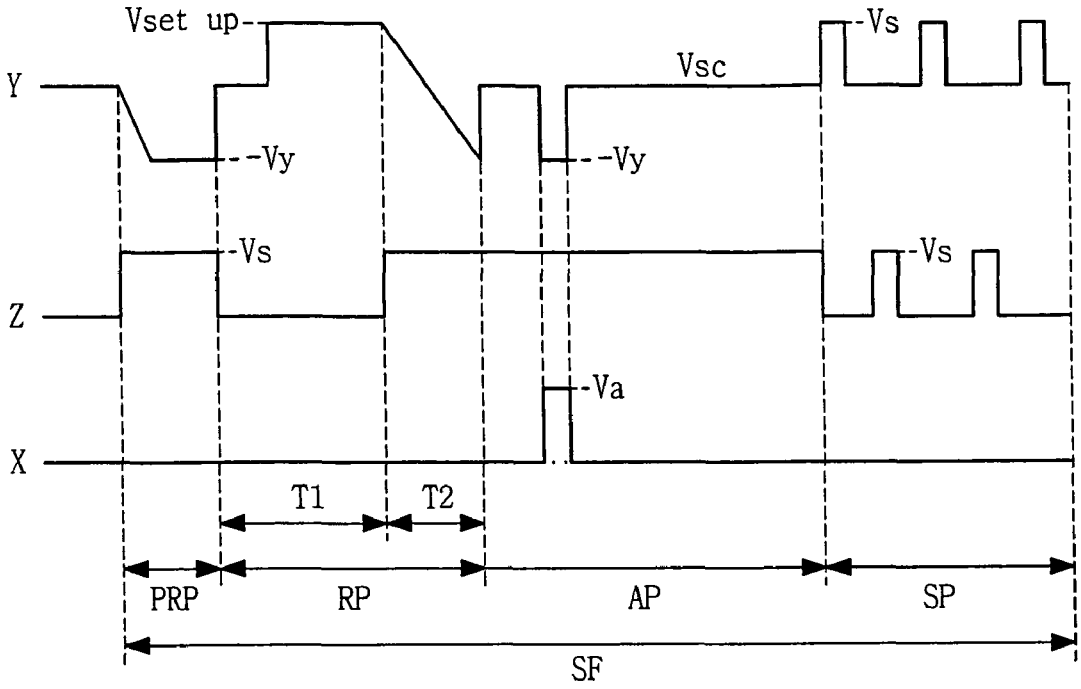
FIGS. 5A and 5B illustrate driving waveforms generated from the plasma display apparatus according to an embodiment of the present invention.
Figure 5B:
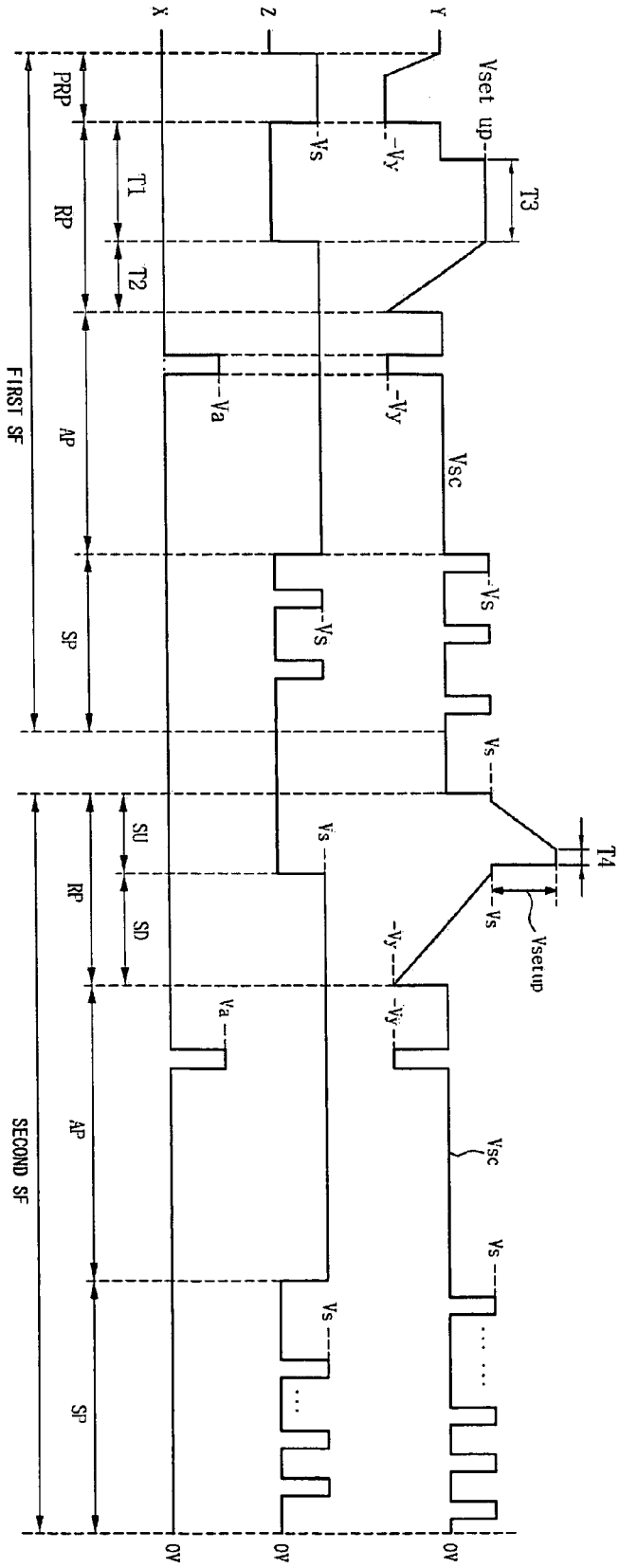

FIG. 4 is a block diagram illustrating the constitution of a scan driver in the plasma display apparatus according to an exemplary embodiment of the present invention, and FIGS. 5A and 5B illustrate driving waveforms generated from the plasma display apparatus according to an exemplary embodiment of the present invention.

Referring to FIGS. 4 and 5A, the plasma display apparatus comprises a scan driver 12 for driving the scan electrodes Y of a panel capacitor Cp1 using a first pulse, a reset pulse, a ground voltage GND, a negative scan voltage, and a sustain pulse, a sustain driver 14 for driving the sustain electrodes Z of the panel capacitor Cp1 using a second pulse, the ground voltage GND and the sustain pulse, and an address driver 16 for driving the address electrodes X of panel capacitors Cp2 and Cp3 using a data voltage Va.

The panel capacitor Cp1 of FIG. 4 equivalently represents capacitance formed between the scan electrodes Y and the sustain electrodes Z of the plasma display panel. This panel capacitor Cp1 generates a sustain discharge by the sustain pulse applied to the scan electrodes Y and sustain electrodes Z.

The panel capacitors Cp2 and Cp3 equivalently represents capacitance formed between the address electrodes X and the scan electrodes Y and between the address electrodes X and the sustain electrodes Z.

Scan Driver

The scan driver 12 supplies to the scan electrodes Y of the panel capacitor Cp1 a first pulse falling from the ground voltage to a negative scan voltage −Vy as a ramp waveform for a pre-reset period PRP before a reset period RP, and supplies a reset pulse falling to the first voltage as the ramp waveform after maintaining the sustain voltage Vs during the reset period RP.

It is desirable that the first voltage is a negative scan voltage −Vy.

The scan driver 12 supplies to the scan electrodes Y of the panel capacitor Cp1 a sustain pulse that alternates with a common negative scan voltage for the address period AP and sustain period SP.

In order to accomplish this operation, the scan driver 12 comprises a sustain voltage source Vs, a negative scan voltage source −Vy, a negative scan voltage supplying unit 21, a scan reference voltage supplying unit 22, a scan integrated circuit 25, and a sustain voltage supplying controller 26.

The negative scan voltage supplying unit 21 is connected to a node N1 together with the scan integrated circuit 25 and the sustain voltage supplying controller 26, and also connected to the negative scan voltage source −Vy. The negative scan voltage supplying unit 21 supplies to the scan electrodes Y of the panel capacitor Cp1 the first pulse falling from the ground voltage to the negative scan voltage −Vy as the ramp waveform.

The negative scan voltage supplying unit 21 comprises a first switch SW1 connected between the first node N1 and the negative scan voltage source −Vy, a first variable resistor R1 connected to a gate terminal of the first switch SW1, and a second switch SW2 connected in parallel with the first switch SW1. The negative scan voltage supplying unit 21 supplies to the scan electrodes Y of the panel capacitor Cp1 the first pulse falling with a predetermined slope from the ground voltage to the negative scan voltage −Vy as the ramp waveform, in response to a switching control signal supplied from a timing controller (not shown), during the pre-reset period PRP before the reset period RP.

In other words, when the first switch SW1 is switched-on in response to the switching control signal supplied from the timing controller at the ground voltage, the ramp waveform with the predetermined slope by the first variable resistor R1 is supplied to the scan electrodes Y of the panel capacitor Cp1. After falling to the scan voltage −Vy, the first switch SW1 is switched-off, and the second switch SW2 of the negative scan voltage supplying controller 21 is switched-on, so that the negative scan voltage −Vy is supplied.

In addition, the negative scan voltage supplying controller 21 supplies to the scan electrodes Y of the panel capacitor Cp1 the ramp waveform falling with the predetermined slope from the sustain voltage Vsetup to the ground voltage, in response to the switching control signal supplied from the timing controller during a predetermined period T2 in the reset period RP.

This ramp waveform falls to the negative scan voltage −Vy using the first switch SW1 and the first variable resistor R1 of the negative scan voltage supplying controller 21, so as to be supplied to the scan electrodes Y of the panel capacitor Cp1.

The scan reference voltage supplying unit 22 comprises a fourth switch SW4 to connect to the scan integrated circuit 25 and the scan reference voltage source Vsc in response to the switching control signal supplied from the timing controller.

The fourth switch SW4 is switched on in response to the switching control signal supplied from the timing controller, and simultaneously, a fifth switch SW5 of the scan integrated circuit 25 is switched on. Thus, the scan reference voltage source Vsc is electrically connected to a second node N2 to supply the scan reference voltage Vsc to the scan electrodes Y of the panel capacitor Cp1.

At this time, a sixth switch SW6 of the scan integrated circuit 25 is operated to connect the negative scan voltage supplying controller 21 and the sustain voltage supplying controller 26, all of which are connected to the first node N1, to the scan electrodes Y of the panel capacitor Cp1.

The negative scan voltage supplying controller 21 supplies the negative scan voltage −Vy of the first pulse to the scan electrodes Y of the panel capacitor Cp1 for the pre-reset period PRP, and supplies the negative scan pulse SCNP having the negative scan voltage −Vy to the scan electrodes Y of the panel capacitor Cp1 during a predetermined time in the address period AP.

The second switch SW2 transfers the negative scan voltage −Vy supplied from the scan voltage source to the first node N1 in response to the switching control signal supplied from the timing controller. Thus, the negative scan voltage −Vy is transferred to the first node N1 in the address period.

The sustain voltage supplying controller 26 supplies the positive sustain voltage Vs to the scan electrodes Y of the panel capacitor Cp1 in response to the switching control signal supplied from the timing controller during a predetermined time T1 in the reset period RP, and simultaneously applies the sustain pulse having the sustain voltage Vs to the scan electrodes Y of the panel capacitor Cp1 for the sustain period SP.

The sustain voltage supplying controller 26 is connected to the first node N1, so that the positive sustain voltage Vs is applied to the scan electrodes Y of the panel capacitor Cp1 in response to the switching control signal supplied from the timing controller during the predetermined time (T1) in the reset period RP, and the sustain voltage Vs is applied to the scan electrodes Y of the panel capacitor Cp1 that alternates with a ground voltage supplying unit 30 for the sustain period.

The sustain voltage supplying controller 26 comprises a seventh switch SW7 connected between the sustain voltage Vs and the first node N1.

The seventh switch SW7 electrically connects the sustain voltage source Vs to the first node N1 for the time T1 in the reset period RP and for the sustain period in response to the switching control signal supplied from the timing controller.

The ground voltage supplying unit 30 is connected to the first node N1 so as to enable a ground voltage GND to be applied to the scan electrodes Y of the panel capacitor Cp1 in the sustain period.

The ground voltage supplying unit 30 comprises a eighth switch SW8 connected between the ground voltage source GND and the first node N1.

The eighth switch SW8 electrically connects the ground voltage source GND to the first node N1 in response to the switching control signal supplied from the timing controller.

Accordingly, the ground voltage GND is applied to the first node N1 for the sustain period.

The eighth switch SW8 and the seventh switch SW7 are alternately operated in the sustain period. Thus, the ground voltage GND and the sustain voltage Vs are alternately transferred to the first node N1 for the sustain period.

The scan integrated circuit 25 comprises the fifth switch SW5 and the sixth switch SW6 that are connected between the first node N1 and the scan reference voltage supplying source Vsc in a push-pull manner.

A common node N2 of the second switch SW2 and the third switch SW3 is connected to the scan electrodes Y of the panel capacitor Cp.

The fifth switch SW5 is connected between the scan reference voltage supplying source Vsc and the second node N2 by the switching control signal from the timing control unit, so as to supply the scan reference voltage Vsc to the scan electrodes Y. The sixth switch SW6 is connected to the first node N1 and the second node N2 so that the scan electrodes Y are connected to the negative scan voltage supplying controller 21, the sustain voltage supplying controller 26, and the ground voltage supplying controller 30, all of which are connected to the first node N1 by the switching control signal of the timing controller.

Sustain Driver

Referring again to FIGS. 4 and 5A, when the negative scan voltage supplying controller 21 of the scan driver 12 supplies the first pulse falling with the predetermined slope from the ground voltage to the negative scan voltage −Vy as the ramp waveform for the pre-reset period PRP, the sustain driver 14 supplies the second pulse having positive polarity opposite to that of the first pulse to the sustain electrodes Z of the panel capacitor Cp1.

The ground voltage GND is applied to the sustain electrodes Z of the panel capacitor Cp1 for the specific time T1.

The sustain driver 14 supplies the bias voltage Vs to the sustain electrodes Z of the panel capacitor Cp1 for the specific time T2 in the reset period and for the address period AP.

It is desirable that the bias voltage is a positive voltage.

The sustain driver 14 alternately supplies the ground voltage GND and the sustain voltage Vs to the sustain electrode Z of the panel capacitor Cp1 for the sustain period SP.

Preferably, the switches SW1~SW8 use a field effect transistor (FET) with a built-in body diode, but is not limited thereto.

As such, the scan driver 12 and the sustain driver 14 supply the first pulse having the negative polarity and the second pulse having the positive polarity to the scan electrodes Y and the sustain electrodes Z of the panel capacitor Cp1 for the pre-reset period before the reset period. Therefore, the reset voltage may be lowered to the extent of the sustain voltage using the voltage and wall charge that are applied between the electrodes Y and Z. Additionally, it is not necessary to supply the ramp waveform rising with the predetermined slope during the set-up to the scan electrodes Y of the panel capacitor Cp1.

Further, the driving voltage is divided to apply to the scan electrodes and the sustain electrodes, thereby lowering an internal voltage of the switching device. Additionally, it is not necessary to use the existing pass switch for isolation between adjacent devices.

Address Driver

The address driver 16 supplies the data voltage Va to the address electrodes X of the panel capacitors Cp2 and Cp3.

The address driver 16 comprises an address voltage supplying unit so as to supply the address pulse or the data pulse each having the positive address voltage Va to the address electrodes X for the address period AP.

According to the present invention, using the driving waveform generated by the plasma display apparatus, the first pulse having the negative polarity and the second pulse having the positive polarity are applied for the pre-reset period PRP before the reset period RP in all subfields of one frame, but are not limited thereto.

For example, the first pulse of the negative polarity and the second pulse of the positive polarity are applied to only a part of the subfields having the different number of emissions in the pre-reset period PRP before the reset period RP. This will be explained in reference with FIG. 5B.

Referring to FIG. 5B, in a first sub-field 1SF, the driving waveform, as explained in FIG. 5A, is applied to the plasma display panel 100.

On the other hand, the pre-reset period PRP is not existed in a second sub-field 2SF differently from the first sub-field 1SF, and the second reset pulse is applied in the reset period RP.

The second reset pulse of the second sub-field 2SF comprises a rising ramp pulse PR that rises with the predetermined slope.

A maximum voltage (Vs+Vsetup) of the second reset pulse is higher than a maximum voltage (Vs) of the first reset pulse of the first sub-field 1SF. A time T4 for maintaining the maximum voltage (Vs+Vsetup) of the second reset pulse is shorter than a time T3 for maintaining the maximum voltage (Vs) of the first reset pulse.

As described above, only the driving waveform of the first sub-field may be applied to the plurality of subfields consisting of one frame. Also, the driving waveforms of the first and second subfields may be applied together.

The plasma display apparatus and driving method thereof according to the present invention produce the following effects.

First, the invention does not use the high voltage switching device, thereby simplifying the constitution of hardware, lowering the manufacturing cost, and decreasing the peak voltage of the reset pulse so as to be driven by the low voltage.

Second, the invention generates the voltage −Vy of the negative scan pulse and the voltage of ramp-down signal using one voltage source, and also generates the voltage Vs of the sustain signal using one voltage source, thereby lowering the manufacturing cost of the plasma display apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel having scan electrodes and sustain electrodes;

a scan driver for supplying a first pulse to the scan electrodes before a reset period of a first subfield, a first reset pulse gradually decreasing after maintaining a constant voltage equal to a maximum voltage of the reset period to the scan electrodes during the reset period, and a second reset pulse having a voltage greater than the constant voltage of the first reset pulse to the scan electrodes during a reset period of a second subfield; and a sustain driver for supplying a second pulse with a polarity opposite a polarity of the first pulse to the sustain electrodes corresponding to the first pulse before the reset period, wherein a maximum voltage of the first reset pulse is substantially equal to a sustain voltage that is applied to the scan electrodes in the sustain period by using wall charge applied between the scan electrodes and the sustain electrodes due to the first pulse and the second pulse before the reset period of the first subfield.

2. The plasma display apparatus of claim 1, wherein the first pulse is a negative pulse and the second pulse is a positive pulse.

3. The plasma display apparatus of claim 2, wherein the first pulse decreases with a predetermined slope from a ground voltage to a first voltage.

4. The plasma display apparatus of claim 3, wherein the first voltage is substantially equal to a negative scan voltage that is applied to the scan electrodes in an address period.

5. The plasma display apparatus of claim 2, wherein the voltage of the second pulse is substantially equal to a sustain voltage that is applied to the sustain electrodes in a sustain period.

6. The plasma display apparatus of claim 1, wherein the second reset pulse comprises a gradually increasing pulse.

7. The plasma display apparatus of claim 1, wherein a time for maintaining a peak voltage of the second reset pulse is shorter than a time for maintaining the constant voltage of the first reset pulse.

8. A plasma display apparatus, comprising:

a plasma display panel having scan electrodes and sustain electrodes;

a scan driver for supplying a first pulse to the scan electrodes before a reset period, a reset pulse gradually decreasing after maintaining a constant voltage to equal to a maximum voltage of the reset period the scan electrodes during the reset period, a scan pulse to the scan electrodes in an address period, and a sustain pulse to the scan electrodes in a sustain period; and a sustain driver for supplying a second pulse with a polarity opposite a polarity of the first pulse to the sustain electrodes corresponding to the first pulse before the reset period, wherein the first pulse, the decreasing reset pulse and the scan pulse are generated from a same voltage source, wherein a maximum voltage of the reset pulse is substantially equal to a sustain voltage that is applied to the scan electrodes in the sustain period by using wall charge applied between the scan electrodes and the sustain electrodes due to the first pulse and the second pulse before the reset period.

9. The plasma display apparatus of claim 8, wherein the same voltage source is a negative scan voltage source.

10. The plasma display apparatus of claim 8, wherein the constant voltage of the reset pulse and a sustain voltage of the sustain pulse are generated from the same voltage source.

11. The plasma display apparatus of claim 10, wherein the same voltage source is a sustain voltage source.

12. The plasma display apparatus of claim 8, wherein the scan driver comprises a sustain supply controller for supplying the constant voltage of the reset pulse and the sustain pulse to the scan electrodes, and a negative scan voltage supply controller for supplying the first pulse and the falling reset pulse to the scan electrodes.

13. The plasma display apparatus of claim 8, wherein the first pulse is a negative pulse and the second pulse is a positive pulse.

14. A method of driving a plasma display apparatus, comprising:

supplying a first pulse to scan electrodes before a reset period;

supplying a second pulse with a polarity opposite a polarity of the first pulse to the sustain electrodes corresponding to the first pulse before the reset period;

supplying a reset pulse gradually decreasing after maintaining a constant voltage equal to a maximum voltage of the reset period to the scan electrodes during the reset period; and supplying alternately a sustain pulse to the scan electrodes and sustain electrodes in a sustain period, wherein a maximum voltage of the reset pulse is substantially equal to a sustain voltage of the sustain pulse by using wall charge applied between the scan electrodes and the sustain electrodes due to the first pulse and the second pulse before the reset period.

15. The method of claim 14, wherein the first pulse is a negative pulse, and the second pulse is a positive pulse.

16. The method of claim 15, wherein a voltage of the second pulse is substantially equal to a voltage of the sustain pulse.

17. The method of claim 14, wherein a bias voltage is applied to the sustain electrodes during the decreasing reset pulse period.

18. The method of claim 17, wherein the bias voltage applied to the sustain electrodes is a positive voltage.

* * * * *